US007374022B2

(12) United States Patent
Schmitt

(10) Patent No.: US 7,374,022 B2
(45) Date of Patent: May 20, 2008

(54) ELEVATOR WITH A CABLE-DRIVEN CAR

(75) Inventor: Günter Schmitt, Am Rüsterbaum 9, Ingelheim (DE) 55218

(73) Assignee: Gunter Schmitt (DE)

( * ) Notice: Subject to any disclaimer, the term of this patent is extended or adjusted under 35 U.S.C. 154(b) by 27 days.

(21) Appl. No.: 10/559,771

(22) PCT Filed: Jun. 4, 2004

(86) PCT No.: PCT/DE2004/001157

§ 371 (c)(1),
(2), (4) Date: May 15, 2006

(87) PCT Pub. No.: WO2004/110914

PCT Pub. Date: Dec. 23, 2004

(65) Prior Publication Data

US 2006/0254863 A1 Nov. 16, 2006

(30) Foreign Application Priority Data

Jun. 7, 2003 (DE) ..... 103 25 937

(51) Int. Cl.
*B66B 7/02* (2006.01)

(52) U.S. Cl. ..... 187/410; 187/404

(58) Field of Classification Search ..... 187/266, 187/404, 410
See application file for complete search history.

(56) References Cited

U.S. PATENT DOCUMENTS

| | | | | | |
|---|---|---|---|---|---|
| 1,566,491 | A | * | 12/1925 | Lindquist | 187/370 |
| 1,782,671 | A | * | 11/1930 | Allred, Jr. | 414/263 |
| 2,088,690 | A | * | 8/1937 | Crispen | 187/254 |
| 4,469,198 | A | * | 9/1984 | Crump | 182/141 |
| 4,592,270 | A | * | 6/1986 | Vener | 454/68 |
| 5,355,976 | A | * | 10/1994 | Goto et al. | 187/406 |

FOREIGN PATENT DOCUMENTS

| | | |
|---|---|---|
| DE | 38 18 856 | 12/1989 |
| DE | 102 12 268 | 1/2003 |
| DE | 203 10 731 U | 9/2003 |
| DE | 20310731 | 9/2003 |
| JP | 5907488 A | 12/1975 |
| JP | 59 074884 | 4/1984 |

* cited by examiner

*Primary Examiner*—Thomas J. Brahan
(74) *Attorney, Agent, or Firm*—Rader, Fishman & Grauer, PLLC

(57) ABSTRACT

An elevator comprises a cable-driven car to which vertical guide rails are allocated. The cables are arranged on both sides of the car, each in a housing and acted upon by a common driving wheel.

23 Claims, 4 Drawing Sheets

ELEVATOR WITH A CABLE-DRIVEN CAR

FIELD

The invention relates to an elevator with a cable-driven car, to which vertical guide rails are allocated.

BACKGROUND

Usually, an elevator is installed within a vertical shaft, which is part of a building structure or connected rigidly to the building structure, so that it forms one unit with the building structure. The shaft is manufactured from concrete, metal, glass, or a combination of these materials and represents a heavy, as well as expensive, building element. However, the shaft is absolutely necessary in order to protect the cables connected to the car from the effects of weather, especially moisture, because moisture negatively affects the friction between the cables and the associated driving wheel. To avoid an expensive shaft in an elevator being arranged in the open, it is known to move the elevator car with a lifting piston directly, or in connection with, cables under a gear transmission ratio of 2:1 in the vertical direction. In such an elevator, however, the lifting height is greatly limited and the speed of the car may not exceed 1 meter per second.

The problem addressed herein is to create an elevator having a cable driven car and vertical guide rails, so that the elevator may be operated in the open using a simple structure and providing greater safety.

BRIEF DESCRIPTION OF THE DRAWINGS

The invention is explained in, more detail below using an embodiment with reference to the associated drawings. Shown are.

DETAILED DESCRIPTION

Figure 1:
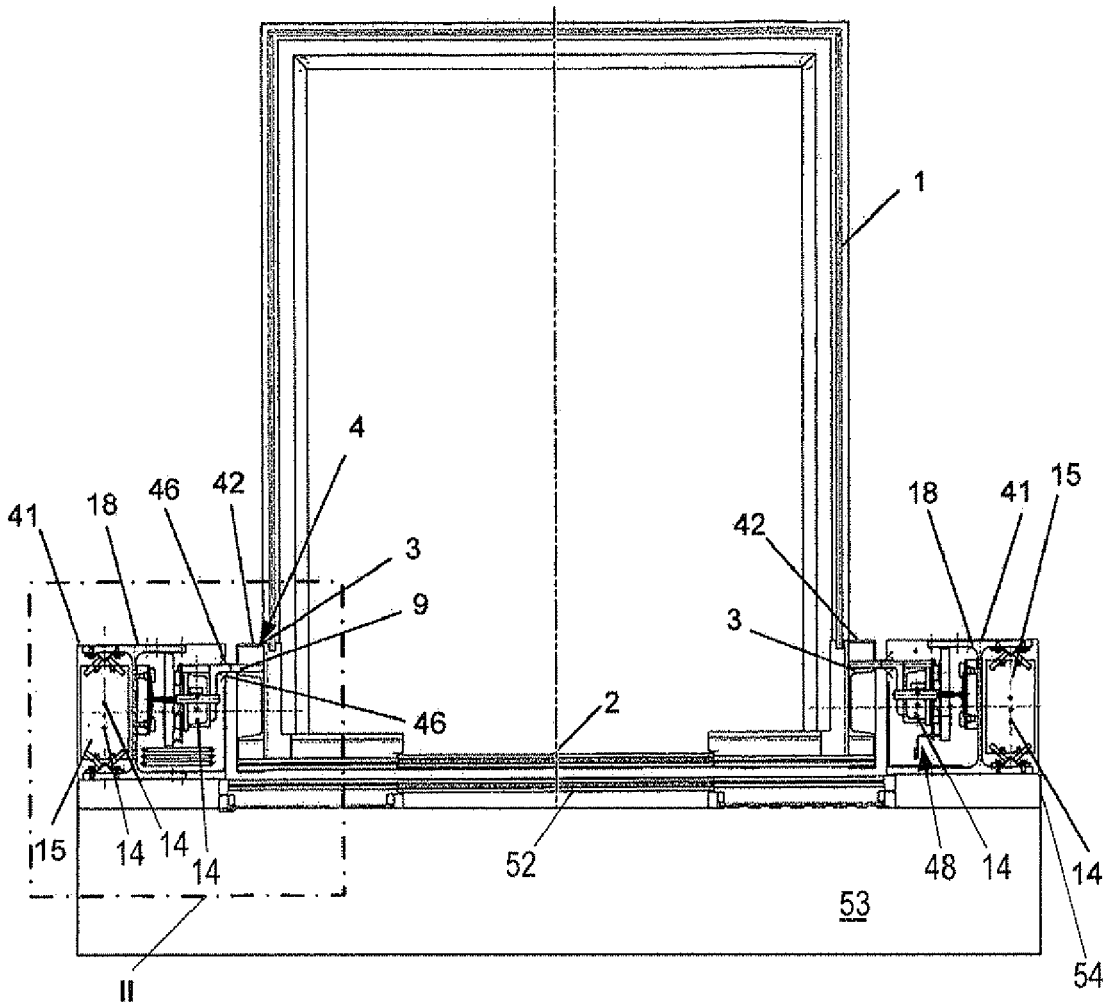
FIG. 1. a sectional view of the elevator.
Figure 2:
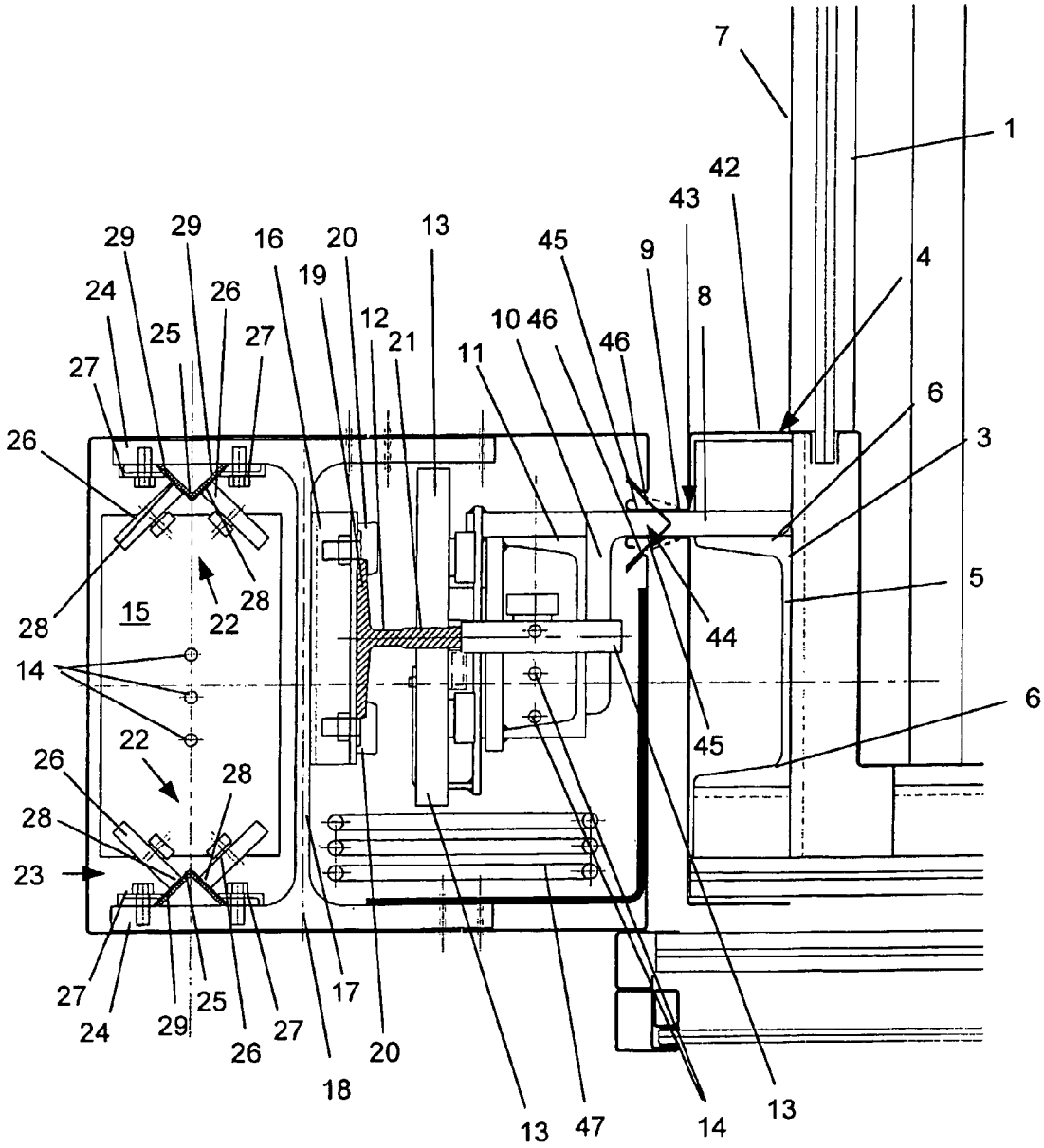
FIG. 2. an enlarged representation of a detail II from FIG. 1.
Figure 3:
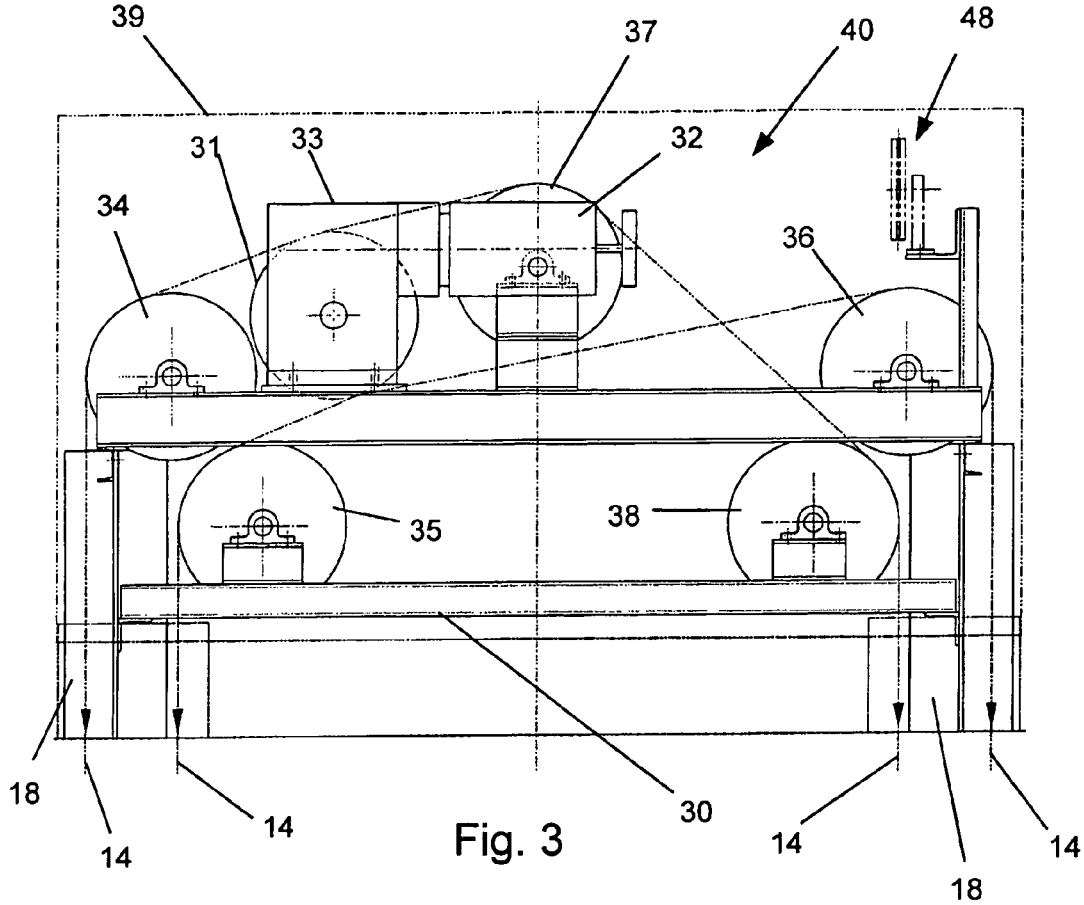
FIG. 3. a front view of a driving gear unit of the elevator from FIG. 2.
Figure 4:
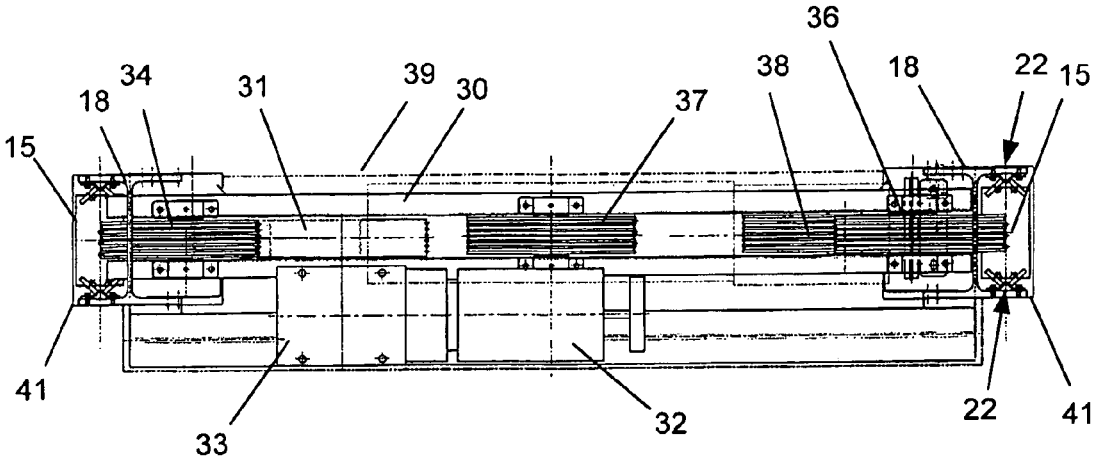
FIG. 4. a plan view of the representation from FIG. 3.
Figure 5:
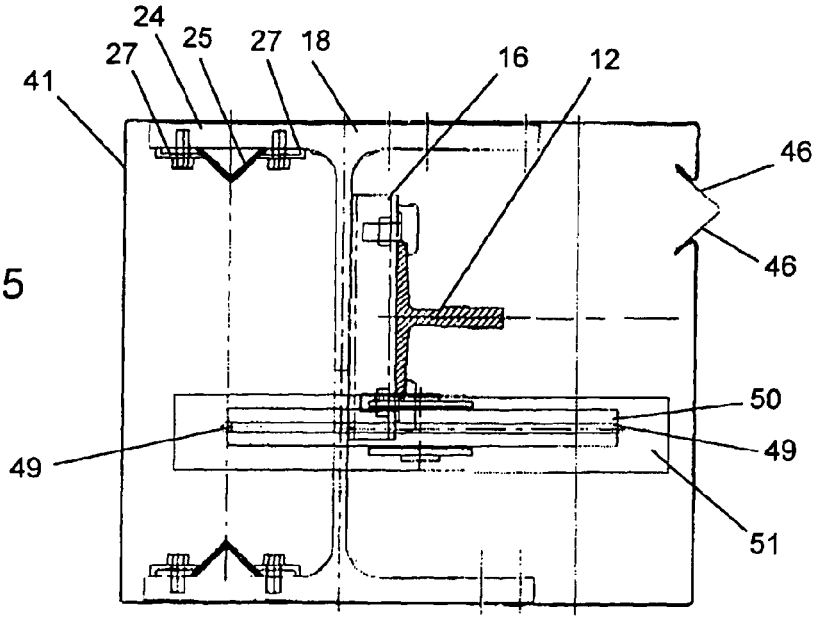
FIG. 5. a view of the detail II from FIG. 1 from below.
Figure 6:
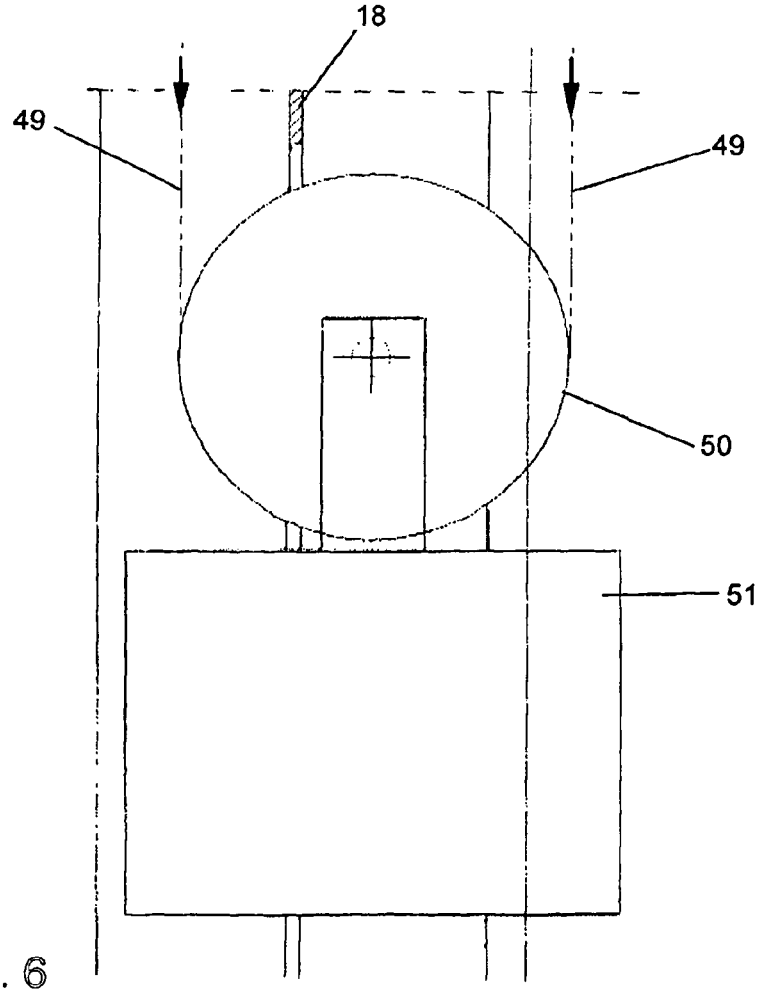
FIG. 6. a side view of the representation from FIG. 5.

According to the invention, cables are arranged on both sides of an elevator car, each in a housing, and are acted upon by a common driving wheel.

Due to this measure, it is unnecessary to install a shaft to protect the cables from the effects of weather, especially moisture, for operation of the elevator in the open. By placing the cables in the housings, reliable operation of the elevator is guaranteed.

Preferably, the cables are coupled on each side of the car, first, with the car, and second, with a counterweight. This is accompanied by a uniform loading of the cables and a reduction of the output of the driving gear of the driving wheel, since the forces acting on it cancel one another out. For achieving a compact construction, the counterweight and the car are located on opposite sides of a vertical carrier that holds the guide rails. The vertical carriers arranged on both sides of the car represent the only essentially static components of the elevator. They can be arranged, for example, in the area provided with a door at the front of the car and can be connected to a building. In addition, the elevator can also be erected free-standing, in that the vertical carriers are held, for example, by means of tension cables. This type of assembly of the vertical carriers and thus of the elevator is possible, for example, for use of the elevator in a tent structure or at a convention booth or on similar, relatively unstable building components.

To configure the vertical carriers so that they are resistant to both bending and buckling and also to pressure, each vertical carrier is preferably embodied as a double-T carrier and arranged in the housing. The vertical carriers can, for instance, be mounted on at least one foundation such that the entire elevator can be set up self-contained, i.e., without additional bracing.

For a space-saving realization of the guide of the cables, the vertical carriers are preferably provided on their top ends with a girder for supporting the driving wheel and also with several deflection rollers for the cables, with the girder extending like a bridge between the two vertical carriers. The deflection rollers are obviously arranged relative to the driving wheel such that the cables encompass them by the angle of wrap corresponding to relevant technical regulations. Preferably, a motor driving the driving wheel is mounted on the girder with the intermediate connection of a gear assembly. With a suitable design of the motor, the gear assembly can be omitted, i.e., the drive can be constructed to be gearless. In addition, the girder carriers control electronics. Obviously, the control electronics, the motor, and the driving gear for the driving wheel can also be arranged stationary under the car and the cables can be led via corresponding deflection rollers to the car.

Advantageously, the vertical carriers are fixed with the end opposite the girder in a shaft pit. The shaft pit, encased in concrete, for example, first, guarantees a reliable attachment of the vertical carriers and, second, provides open space underneath the car in its bottom-most end position. For additional reinforcement, the vertical carriers are connected to each other by means of several separated crossbars.

Preferably, the connecting piece of each vertical carrier is aligned parallel to the car and carries the guide rails on the side facing the car. Thus, the guide rails are arranged within the U-shaped open space, fixed by the flanges and the connecting piece of the vertical carrier. For preventing an uncontrollable oscillatory movement of the counterweight, the flanges, according to one improvement of the invention, include guide means on the side of the vertical carrier opposite the guide rails in order to support the counterweight in the corresponding U-shaped recess of the vertical carrier. Due to the arrangement of the counterweight and the guide rails relative to the connecting piece of the vertical carrier, the vertical carrier essentially experiences compression loading.

To realize a relatively low-wear guide of the counterweight, the guide means are preferably formed as opposite angular profiles fixed to the flanges. Guide rollers fixed to the counterweight are supported on these guide means. In this way, for example, the tip of the angular profile points in the direction of the counterweight and the guide rollers are aligned such that their running surfaces roll completely over the legs of the angular profile.

Advantageously, the guide rails with T-shaped cross section are fixed to the connecting piece of the vertical carrier with the intermediate arrangement of a holder profile, such that their foot runs parallel to the connecting piece of the vertical carrier and their connecting piece guided between car-side rollers points in the direction of the car. Because both guide rails and rollers are located on both sides of the car, the car is reliably supported, with the support permitting only an up-and-down movement of the car.

To implement a relatively low-draft holder for the guide rails, these can be fixed to the holder profile, for example, by means of tension brackets, and the holder profile can be welded, in turn, to the vertical carrier. According to another embodiment of the invention, the rollers are supported on a U-profile, which is connected to a frame of the car by means of an angular carrier. A carrier made from a U-profile or a flat profile can also be used, for example, instead of an angular carrier, and the U-profile can be replaced with, for instance, an angled profile.

Preferably, the frame is assembled from profiles with U-shaped cross sections, with the profiles extending over the height of the car, pointing with their legs in the direction of the associated vertical carrier and with one leg of the profile being connected to one leg of the angular profile, the other leg of which holds the U-profile. Due to this relatively rigid construction, contact of the rollers on the associated guide rails is always guaranteed.

In order to protect the coupling area between the car and the vertical carriers or the guide rails connected thereto from the effects of weather a protective housing, which extends over the height of the car and which covers the corresponding profiles of the frame and which features a passage for the leg of the angular leg allocated to the corresponding profile, is preferably arranged on both sides of the car. This angular leg passes through a slot of the housing that holds the associated vertical carrier. Thus, the openings, namely, first, the passage of the protective housing, and, second, the slot of the housing, through which moisture could penetrate, are kept relatively small, wherein, nevertheless, a reliable support of the car between the vertical carriers is guaranteed. Preferably, the passage is formed between two projections of the protective housing, which pass through the slot of the housing. Thus, the housing is interleaved with the protective housing in the area of the openings, and penetration of water is prevented. Advantageously, on both sides of the slot, the housing carries sealing lips, which contact the projections of the protective housing and which are aligned in a V-shape relative to each other. Thus, rain or snow appearing on the protective housing or the housing is prevented from entering into the interior of the housing and from negatively affecting the cables or the guides.

Preferably, electric cables are within the corresponding housing of one guide rail, and within the other guide rail is a trigger device for a safety catch. Advantageously, the electric cables project through the slot of the housing, and the passage of the protective housing, into the interior of the car. Thus, the electric cables, which are used, first, for supplying power to loads within the car and, second, for controlling the elevator, and also the trigger device for the safety catch, which acts upon the two guide rails as is known from the state of the art, are protected from weather within the housing.

Advantageously, the driving wheel and the deflection rollers are covered by a hood. Obviously, under this hood are also the motor, the gear assembly, as well as control devices, which are thus protected from the weather, so that the elevator is suitable for erecting in the open. For maintenance work, the hood can be pivotably articulated, or can feature a flap or a door.

According to another advantageous configuration of the invention, a wire cable is fixed, first, to the associated counterweight, and, second, to the car, on both sides of the car, with the wire cable running underneath the associated vertical carrier and holding a deflection roller with a tension weight. Thus, to trigger the safety catch to an emergency braking device, a chain block is fixed to the wire cable, in order to draw the car either upward or downward for a released driving brake. Because the car can be caught both during upward travel and also during downward travel, different procedures for triggering the safety catch are necessary. After emergency braking during downward travel, the car must be moved upward. For this purpose, on the section of the wire cable associated with the counterweight, an end of the chain block is fixed, the other end of which is fixed farther below in a shaft pit, in which the deflection roller with the tension weight is found. When a force is applied to the chain block for tensioning the chain block, the counterweight moves downward and consequently the car moves upward, so that the safety catch comes out of engagement. After emergency braking during upward movement, it is necessary to move the car downward. Thus, an end of the chain block, the other end of which is fixed farther above, is mounted on the section of the wire cable allocated to the counterweight. The tensioning device is fixed, for example, by fixing the deflection roller. Then, after the driving brake of the elevator is released, the car is moved downward in order to bring the safety catch out of engagement.

So that users of the elevator or its drive components can be protected from heat and/or cold, the car and/or the area covered by the hood are connected to a heating and/or cooling system for climate control.

In order to permit the users of an elevator installed in front of a building to have a comfortable passage from the car to the building, a balcony is preferably arranged between an outside door of the elevator and a building at the level of the floor of each story. The balconies simultaneously serve as shelter for the balconies below; of course, a roof can be provided above the balcony for the highest story. It is also possible to dimension the balconies such that they can also be used as seats.

Several balconies are preferably connected to one another by means of a skeleton. The skeleton is expediently free-standing or fastened to the building and/or the vertical carriers. Alternatively, the balconies can be arranged on the vertical carriers.

It is understood that the previously mentioned features and features still to be explained below can be used not only in the indicated combinations, but also in other combinations. The scope of the present invention is defined only by the claims.

The elevator comprises a car 1, which is suitable for transporting several persons and which is provided with a door 2 and which is reinforced by a frame 4 assembled from profiles 3, with the frame 4 being arranged in the region of the side of the car 1 with the door 2. In front of each story, an outside door 52 as well as a balcony 53 is associated with the elevator in order to permit a comfortable passage from the car 1 to a building. The profiles 3 feature a U-shaped cross section, with the profiles 3 extending over the height of the car 1 being aligned with their connecting pieces 5 in the direction of the car 1 and the legs 6 of the profiles 3 running perpendicular to the outer wall 7 of the car 1. One of the legs 6 of the profile 3 is rigidly connected to a leg 8 of an angular profile 9, the other leg 10 of which extends over the profile 3 at a distance and holds a U-profile 11 on the side facing away from the car 1. Rollers 13 interacting with vertical guide rails 12 and also one end of cable 14, the other end of which is fixed to a counterweight 15, are mounted to the U-profile 11. The guide rail 12 with a T-shaped cross section is connected to a connecting piece 17 of a vertical carrier 18 configured as a double-T carrier under intermediate arrangement of a holding profile 16, with the foot 19 of the guide rail 12 being fixed to the holding profile 16 welded to the vertical carrier 18 by means of tension brackets 20 running parallel to the connecting piece 17 of the vertical carrier 18. The connecting piece 21 of the guide rail 12 pointing in the direction of the car 1 is guided both with its parallel longitudinal sides and also on the front between the rollers 13. Because this type of support is present on both sides of the car 1, it features degrees of freedom only in the vertical direction.

On the side of the vertical carrier 18 opposite the guide rail 12, guide means 22 for supporting the counterweight 15 in the corresponding U-shaped recess 23 of the vertical carrier 18 are provided, with the guide means 22 comprising angular profiles 25 fixed to the opposite flanges 24 of the vertical carrier 18 and also guide rollers 26 supported on the counterweight 15. The tips of the angular profiles 25 fixed with tension brackets 27 to the flanges 24 of the vertical carrier 18 point in the direction of the counterweight 15 and are arranged in its middle. The guide rollers 26 are aligned such that their running surfaces 28 roll on the associated legs 29 of the angular profile 25.

On the upper end of the two vertical carriers 18, there is a girder 30, on which a driving wheel 31 is supported, which is driven by a motor 32 under the intermediate connection of a gear assembly 33. Starting from the counterweight 15, the cable 14 arranged on the left side of the car 1 runs over a first deflection roller 34 over the driving wheel 31, as well as a second deflection roller 35 arranged under the driving wheel 31 and the first deflection roller 34, to the U-profile 11, to which it is fixed. As a function of the carrying power of the elevator, obviously multiple cables 14 can follow this profile.

In the present embodiment there are three cables 14, one lying next to the other. The cables 14 on the right side of the car 1 are guided starting from the associated counterweight 15 to a third deflection roller 36 and from there over the driving wheel 31, as well as over a fourth deflection roller 37 and a fifth deflection roller 38 connected after the wheel, to the car-side mount. The arrangement of all of the deflection rollers 34, 35, 36, 37, 38 relative to the driving wheel 31 is selected such that the cables 14 wrap around the driving wheel 31 uniformly at a certain angle in order, first, to prevent slippage of the cables 14 and, second, to guarantee a uniform driving of the car 1.

To protect from the effects of weather, especially from moisture, a hood 39, which covers all of the driving parts 40 of the elevator, is arranged on the girder 30. The hood 39 is connected on both sides of the car 1 to housings 41, in which the cables 14 run and the vertical carriers 18, as well as the guide rails 12 and the counterweight 15 are held, and which extend over the entire height of the vertical carrier 18. In addition, protective housings extending over the height of the car 1 on both sides are provided for holding the profiles 3 of the frame 4. For coupling the car 1 to the guide rail 12, the protective housing 42 features a passage 43 for the leg 8 allocated to the profile 3 of the frame 4 for the angular profile 9, which passes through a slot 44 of the housing 41. The passage 43 is formed between two projections 45 of the protective housing 42 and features an elliptical shape, whose major axis runs along the height of the car 1. The two projections 45 pass through the slot 44 of the housing 41. For forming seals, sealing lips 46, which are aligned in a V-shape relative to each other and which contact the projections 45 of the protective housing 42, are provided on both sides of the slot 44 of the housing 41. Due to the elliptical shape of the passage 43, the sealing lips 46 are located above and below the passage 43 in mutual contact and otherwise follow the geometry of the projections 45, so as to effectively prevent the penetration of water into both the housing 41 and also the protective housing 42.

In order to supply electrical devices within the car 1 with voltage and to implement the control of the elevator, electric cables 47 are arranged in the housing 41 provided on the left side of the car 1. These electric cables are guided, first, to the girder 30 and second, through the slot 44 of the housing 41, as well as through the passage 43 of the protective housing 42, into the car 1. On the right side of the car 1 there is a tension cable of a safety catch 48, which acts on the guide rails 12 in a known way.

For triggering the safety catch 48 interacting with the vertical carriers 18, on both sides of the car 1 there is a wire cable 49, which is fixed first to the associated counterweight 15 and second to the car 1 on the floor side. The wire cables 49 run underneath the associated vertical carrier 18 into a shaft pit, each holding a deflection roller 50 with a tension weight 51.

LIST OF REFERENCE SYMBOLS

1 Car
2 Door
3 Profile
4 Frame
5 Connecting piece of 3
6 Leg of 3
7 Outer wall of 1
8 Leg of 9
9 Angular profile
10 Leg of 9
11 U-profile
12 Guide rail
13 Roller
14 Cable
15 Counterweight
16 Holder profile
17 Connecting piece of 18
18 Vertical carrier
19 Foot of 12
20 Tension bracket
21 Connecting piece of 12
22 Guide means
23 Recess of 18
24 Flange of 18
25 Angular profile
26 Guide roller
27 Tension bracket
28 Running surface
29 Leg of 25
30 Girder
31 Driving wheel
32 Motor
33 Gear assembly
34 First deflection roller
35 Second deflection roller
36 Third deflection roller
37 Fourth deflection roller
38 Fifth deflection roller
39 Hood
40 Driving gear part
41 Housing
42 Protective housing
43 Passage

44 Slot
45 Projection
46 Sealing lip
47 Electric cable
48 Safety catch
49 Wire cable
50 Deflection roller
51 Tension weight
52 Outside door
53 Balcony

The invention claimed is:

1. An elevator comprising:

a plurality of vertical carriers arranged about a car, each carrier including:

first and second opposing recesses;

a guide rail having a plurality of vertical surfaces disposed within the first recess;

a truck attached to the car having a plurality of rollers surrounding the plurality of vertical surfaces of the guide rail;

a counterweight disposed within the second recess; and at least one cable connecting the truck and the counterweight, wherein the cables of the plurality of vertical carriers are acted upon by a common driving wheel.

2. The elevator according to claim 1, wherein each vertical carrier is arranged within a respective housing and is formed as a double-T carrier.

3. The elevator according to claim 1, further comprising a girder provided on the upper ends of the vertical carriers for supporting the driving wheel, and a plurality of deflection rollers for the cables, wherein the girder extends between at least two vertical carriers.

4. The elevator according to claim 3, further comprising a motor capable of driving the driving wheel under an intermediate connection of a driving gear for the driving wheel, wherein the motor is mounted on the girder.

5. The elevator according to claim 3, further comprising control electronics included on the girder.

6. The elevator according to claim 3, wherein the vertical carriers each have an end opposite the girder fixed in a shaft pit.

7. The elevator according to claim 3, wherein the vertical carriers are connected to each other by a plurality crossbars spaced from each other.

8. The elevator according to claim 3, further comprising a hood that covers the driving wheel and the deflection rollers.

9. The elevator according to claim 1, further comprising a connecting piece for each vertical carrier interconnecting the first recess of the vertical carrier to the guide rail.

10. The elevator according to claim 1, further comprising a plurality of vertically extending guide surfaces fixed within the second recess configured to support the counterweight.

11. The elevator according to claim 1, wherein the vertically extending guide surfaces are formed as angular profiles that are fixed to at least two oposing sides of the second recess and on which guide rollers fixed to the counterweight are supported.

12. The elevator according to claim 9, wherein each guide rail has a generally T-shaped cross section including a cross member fixed to the connection piece by a plurality of tension brackets and a roller support member connected to the cross member proving the plurality of vertical surfaces of the guide rail.

13. The elevator according to claim 1, wherein the truck includes a U-profile that is connected via an angular profile to a frame of the car.

14. The elevator according to claim 13, wherein the frame is assembled from frame profiles having generally U-shaped cross sections having legs pointing toward an associated vertical carrier and with one leg of the profile being connected to a first leg of the angular profile, and wherein at least a subset of the frame profiles extending over the car.

15. The elevator according to claim 14, further comprising a protective housing enclosing the frame profiles, a passage through the protective housing for the first leg of the angular profile, and a slot provided on the housing of at least a subset of the vertical carriers for the leg of the angular profile.

16. The elevator according to claim 15, further comprising at least two sealing lips included with the slot, wherein the sealing lips are aligned in a V-shape relative to each other and which contact opposing sides of the first leg of the angular profile.

17. The elevator according to claim 15, further comprising electric cables within the housing of at least one vertical carrier and a trigger device for a safety catch within the housing of at least one vertical carrier.

18. The elevator according to claim 17, wherein the electric cables project through the slot and the passage into the interior of the car.

19. The elevator according to claim 1, further comprising a wire cable that is fixed at a first end to the corresponding counterweight and at a second end to the car on each of the two sides of the car, the wire cable running underneath one of the vertical carriers and holding a deflection roller and a tension weight.

20. The elevator according to claim 1, further comprising a balcony that is disposed between an outside door of the elevator and a building, the balcony being disposed in proximity to a floor of a story of the building.

21. The elevator according to claim 20, further comprising a plurality of balconies that are connected to one another by a skeleton.

22. The elevator according to claim 21, wherein the skeleton is free-standing or is fastened to at least one of the building and the vertical carriers.

23. The elevator according to claim 20, wherein the balconies are disposed on the vertical carriers.

* * * * *

UNITED STATES PATENT AND TRADEMARK OFFICE

CERTIFICATE OF CORRECTION

PATENT NO. : 7,374,022 B2
APPLICATION NO. : 10/559771
DATED : May 20, 2008
INVENTOR(S) : Guenter Schmitt et al.

It is certified that error appears in the above-identified patent and that said Letters Patent is hereby corrected as shown below:

Title Page:

Item [73], Assignee, replace "Gunter Schmitt (DE)" with --Schmitt Aufzuge Gmbh--

In Claim 11, line 56, replace "claim 1" with --claim 10--.

In Claim 11, line 1, replace "oposing" with --opposing--

Signed and Sealed this

Twenty-sixth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,374,022 B2
APPLICATION NO. : 10/559771
DATED : May 20, 2008
INVENTOR(S) : Guenter Schmitt et al.

It is certified that error appears in the above-identified patent and that said Letters Patent is hereby corrected as shown below:

Title Page:

Item [73], Assignee, replace "Gunter Schmitt (DE)" with --Schmitt Aufzuge Gmbh--

Column 7, in Claim 11, line 56, replace "claim 1" with --claim 10--

Column 8, in Claim 11, line 1, replace "oposing" with --opposing--

This certificate supersedes the Certificate of Correction issued August 26, 2008.

Signed and Sealed this

Sixteenth Day of September, 2008

JON W. DUDAS
*Director of the United States Patent and Trademark Office*